US010925448B2

(12) United States Patent
Thorne et al.

(10) Patent No.: US 10,925,448 B2
(45) Date of Patent: Feb. 23, 2021

(54) SURFACE CLEANING HEAD WITH LEADING ROLLER

(71) Applicant: SHARKNINJA OPERATING LLC, Needham, MA (US)

(72) Inventors: Jason B. Thorne, Wellesley Hills, MA (US); Daniel Meyer, Boston, MA (US); Andre David Brown, Natick, MA (US); Sam Liu, Needham, MA (US)

(73) Assignee: SharkNinja Operating LLC, Needham, MA (US)

( * ) Notice: Subject to any disclaimer, the term of this patent is extended or adjusted under 35 U.S.C. 154(b) by 207 days.

(21) Appl. No.: 15/768,879

(22) PCT Filed: Oct. 21, 2016

(86) PCT No.: PCT/US2016/058148

§ 371 (c)(1),
(2) Date: Apr. 17, 2018

(87) PCT Pub. No.: WO2017/070489

PCT Pub. Date: Apr. 27, 2017

(65) Prior Publication Data

US 2018/0296046 A1 Oct. 18, 2018

Related U.S. Application Data

(60) Provisional application No. 62/244,331, filed on Oct. 21, 2015, provisional application No. 62/248,813,
(Continued)

(51) Int. Cl.
*A47L 9/04* (2006.01)
*A47L 9/06* (2006.01)
(Continued)

(52) U.S. Cl.
CPC ..... *A47L 9/0488* (2013.01); *A47L 5/26* (2013.01); *A47L 5/30* (2013.01); *A47L 5/34* (2013.01);
(Continued)

(58) Field of Classification Search
CPC ..... A47L 5/26; A47L 5/30; A47L 5/34; A47L 9/0405; A47L 9/0477; A47L 9/0488;
(Continued)

(56) References Cited

U.S. PATENT DOCUMENTS 2,032,345 A 3/1936 Cranon
2,607,062 A 8/1952 Le Febvre
(Continued)

FOREIGN PATENT DOCUMENTS

DE 102010017211 A1 12/2011
DE 102010017258 A1 12/2011
(Continued)

OTHER PUBLICATIONS

Chinese Office Action with English translation dated Jan. 2, 2020, received in Chinese Patent Application No. 201680061488.6, 11 pgs.
(Continued)

*Primary Examiner* — Marc Carlson
(74) *Attorney, Agent, or Firm* — Grossman Tucker Perreault & Pfleger, PLLC

(57) ABSTRACT

A surface cleaning head with a leading roller may be used to facilitate capturing of debris in the air flow into a suction conduit on the underside of the surface cleaning head. The leading roller is generally positioned adjacent to and in advance of the opening of the suction conduit. The surface cleaning head may have dual agitators—a leading roller and a rotating brush roll—with the leading roller being located in front of the brush roll. The leading roller may have a
(Continued)

smaller diameter than the brush roll and may provide a softer cleaning element. The leading roller may also have a bottom portion exposed to the flow path to the suction conduit and at least a top half that is not exposed to that flow path. The leading roller may also float relative to the surface cleaning head and/or may be adjustable relative to the brush roll.

23 Claims, 12 Drawing Sheets

Related U.S. Application Data filed on Oct. 30, 2015, provisional application No. 62/313,394, filed on Mar. 25, 2016.

(51) Int. Cl.
*A47L 5/34* (2006.01)
*A47L 5/26* (2006.01)
*A47L 5/30* (2006.01)
*A47L 9/30* (2006.01)

(52) U.S. Cl.
CPC ..... *A47L 9/0405* (2013.01); *A47L 9/0477* (2013.01); *A47L 9/0494* (2013.01); *A47L 9/0606* (2013.01); *A47L 9/0673* (2013.01); *A47L 9/30* (2013.01)

(58) Field of Classification Search
CPC .... A47L 9/0494; A47L 9/0606; A47L 9/0673; A47L 9/30
See application file for complete search history.

(56) References Cited

U.S. PATENT DOCUMENTS 4,138,762 A 2/1979 Jost et al.
4,334,337 A 6/1982 Miller et al.
4,372,004 A * 2/1983 Vermillion ..... A46B 7/04 15/182
4,627,127 A 12/1986 Dupre
4,912,805 A 4/1990 Krasznai et al.
D348,548 S 7/1994 Pino
5,960,514 A 10/1999 Miller et al.
D440,019 S 4/2001 Mehaffey et al.
6,237,188 B1 * 5/2001 Takemoto ..... A47L 5/14 15/327.3
7,171,723 B2 2/2007 Kobayashi et al.
7,328,479 B2 * 2/2008 Willenbring ..... A47L 9/2805 15/319
D594,612 S 6/2009 Umeda
D619,315 S 7/2010 Ayers
7,769,490 B2 8/2010 Abramson et al.
D635,728 S 4/2011 Fjellman
7,979,952 B2 7/2011 Beskow et al.
D655,468 S 3/2012 Karsan
D668,010 S 9/2012 Stickney et al.
8,402,600 B2 3/2013 Beskow et al.
D681,291 S 4/2013 Morgan et al.
8,418,303 B2 4/2013 Kapoor et al.
8,726,441 B1 5/2014 Colasanti et al.
8,745,818 B2 6/2014 Iles et al.
9,027,198 B2 5/2015 Conrad
D731,130 S 6/2015 Dyson et al.
D731,134 S 6/2015 Dyson et al.
D731,136 S 6/2015 Yun et al.
D731,720 S 6/2015 Gidwell et al.
D731,724 S 6/2015 Cheon et al.
9,066,640 B2 6/2015 Iles et al.
D738,583 S 9/2015 Gidwell et al.
D738,584 S 9/2015 Niedzwecki
9,144,356 B2 9/2015 Yun
D741,558 S 10/2015 Kerr
D742,083 S 10/2015 Gidwell et al.
D743,123 S 11/2015 Chu
D745,231 S 12/2015 Niedzwecki
D747,571 S 1/2016 Dyson
D747,572 S 1/2016 Kerr
9,314,140 B2 4/2016 Eriksson
D761,507 S 7/2016 Heck et al.
9,451,853 B2 9/2016 Conrad et al.
D770,111 S 10/2016 Lee et al.
9,456,723 B2 10/2016 Thorne et al.
9,468,346 B1 10/2016 Rzepka
D771,890 S 11/2016 Kim
D772,512 S 11/2016 Yoon et al.
D773,139 S 11/2016 Palladino
D774,260 S 12/2016 Manning
D789,007 S 6/2017 Jang et al.
D790,785 S 6/2017 Courtney et al.
D792,665 S 7/2017 Salagnac
2002/0124334 A1 * 9/2002 Worwag ..... A47L 9/0411 15/52.1
2003/0106183 A1 6/2003 Frederick et al.
2005/0172447 A1 * 8/2005 Roney ..... A47L 9/0411 15/384
2006/0037170 A1 2/2006 Shimizu
2006/0191097 A1 8/2006 Baumhakel
2009/0229075 A1 9/2009 Eriksson
2010/0107359 A1 * 5/2010 Yoo ..... A47L 5/34 15/415.1
2010/0287717 A1 11/2010 Jang et al.
2010/0306958 A1 12/2010 Follows et al.
2011/0219571 A1 9/2011 Dyson et al.
2012/0000030 A1 1/2012 Conrad
2012/0011676 A1 1/2012 Jung et al.
2012/0169497 A1 7/2012 Schnittman et al.
2012/0198644 A1 8/2012 Iles
2012/0311813 A1 12/2012 Gilbert, Jr. et al.
2013/0139349 A1 * 6/2013 Iles ..... A47L 9/0488 15/383
2013/0212831 A1 8/2013 Follows et al.
2013/0298350 A1 * 11/2013 Schnittman ..... A47L 11/4069 15/319
2014/0060577 A1 3/2014 Bruders et al.
2014/0150202 A1 * 6/2014 Schultheis ..... A46B 7/044 15/398
2014/0196247 A1 * 7/2014 Kasper ..... A47L 5/30 15/347
2014/0237760 A1 8/2014 Conrad
2014/0259475 A1 9/2014 Doughty
2014/0259521 A1 9/2014 Kowalski
2015/0033498 A1 2/2015 McVey
2015/0135477 A1 * 5/2015 Davidshofer ..... A47L 5/30 15/383
2015/0289735 A1 10/2015 Van Der Kooi et al.
2015/0359396 A1 12/2015 Yun
2016/0058257 A1 3/2016 Ventress et al.
2016/0220082 A1 8/2016 Thorne et al.
2016/0220083 A1 * 8/2016 Thorne ..... A47L 5/30
2016/0345795 A1 12/2016 Manning
2017/0079493 A1 3/2017 Genn et al.
2017/0127896 A1 5/2017 Carter et al.
2017/0231445 A1 8/2017 Kasper

FOREIGN PATENT DOCUMENTS

EP 1994869 11/2008
EP 2218385 A3 3/2013
EP 2543301 9/2013
GB 877778 A 9/1961
GB 2109224 6/1983
GB 2476811 7/2011
GB 2529819 9/2016
JP 03228721 A 10/1991
JP 05228083 A 9/1993
JP 2639155 B2 8/1997
JP H11187997 A 7/1999
JP 2001120473 A 5/2001
JP 2003339589 A 12/2003
JP 2004222912 A 8/2004
JP 2006247229 A 9/2006

(56) References Cited

FOREIGN PATENT DOCUMENTS

| | | | |
|---|---|---|---|
| JP | 2006312066 | A | 11/2006 |
| KR | 20040052092 | A | 6/2004 |
| KR | 100593324 | B1 | 6/2006 |
| WO | 9210967 | A1 | 7/1992 |
| WO | 2009117383 | | 9/2009 |
| WO | 2011083294 | A1 | 7/2011 |
| WO | 2014177216 | | 11/2014 |
| WO | 2015015166 | | 2/2015 |
| WO | 2015015167 | | 2/2015 |
| WO | 2016034848 | | 3/2016 |
| WO | 2017070492 | A1 | 4/2017 |

OTHER PUBLICATIONS

Extended European Search Report dated Mar. 28, 2019, received in EP Application No. 16858305.2, 7 pgs.
English translation of Japanese Office Action dated May 21, 2019, received in Japanese Application No. 2018-520541, 11 pgs.
English translation of Korean Office Action dated Apr. 30, 2019, received in Korean Application No. 10-2018-7014180, 11 pgs.
U.S. Office Action dated May 3, 2019, received in U.S. Appl. No. 15/331,045, 9 pgs.
Extended European Search Report dated Apr. 3, 2019, received in EP Application No. 16858308.6, 7 pgs.
English translation of Japanese Office Action dated Apr. 1, 2019, received in Japanese Application No. 2017-557189, 6 pgs.
U.S. Office Action dated May 15, 2019, received in U.S. Appl. No. 15/492,320, 13 pgs.
English translation of Japanese Office Action dated Dec. 2, 2019, received in JP Application No. 2018-520541, 6 pgs.
English translation of Korean Office Action dated Nov. 27, 2019, received in Korean Application No. 10-2018-7014180, 5 pgs.
U.S. Office Action dated Sep. 17, 2019, received in U.S. Appl. No. 15/685,456, 11 pgs.
U.S. Office Action dated Oct. 23, 2019, received in U.S. Appl. No. 15/492,320, 14 pgs.
English translation of Korean Office Action dated May 31, 2019, received in Korean Application No. 10-2018-7014186, 8 pgs.
English translation of Japanese Decision of Rejection dated Jan. 6, 2020, received in Japanese Application No. 2017-557189, 5 pgs.
Chinese Office Action with English translation dated Feb. 25, 2020, received in Chinese Patent Application No. 201610921399.6, 18 pgs.
Chinese Office Action with English translation dated Mar. 2, 2020, received in Chinese Patent Application No. 201711481216.4, 16 pgs.
Chinese Office Action with English translation dated Mar. 25, 2020, received in Chinese Patent Application No. 201711405708.5, 11 pgs.
PCT Search Report and Written Opinion dated Dec. 26, 2018, received in PCT Application No. PCT/US18/47525, 14 pgs.
Australian Examination Report dated Oct. 23, 2018, received in AU Application No. 2016341998, 5 pgs.
Australian Examination Report dated Oct. 16, 2018, received in AU Application No. 2016342001, 5 pgs.
International Search Report and Written Opinion dated Mar. 17, 2017 in corresponding PCT Patent Application No. PCT/US 16/58155, 12 pgs.
International Search Report and Written Opinion dated Mar. 24, 2017 in corresponding PCT Patent Application No. PCT/US 16/58148, 14 pgs.
PCT Search Report and Written Opinion dated Aug. 23, 2018, received in PCT Application No. PCT/US18/34320, 11 pgs.
PCT Search Report and Written Opinion dated Jul. 18, 2018, received in PCT Application No. PCT/US18/28635, 16 pgs.

* cited by examiner

SURFACE CLEANING HEAD WITH LEADING ROLLER

CROSS-REFERENCE TO RELATED APPLICATIONS

The present disclosure claims the benefit of U.S. Provisional Patent Application Ser. No. 62/244,331 filed Oct. 21, 2015, U.S. Provisional Patent Application Ser. No. 62/248,813 filed Oct. 30, 2015, and U.S. Provisional Patent Application Ser. No. 62/313,394 filed Mar. 25, 2016, all of which are fully incorporated herein by reference.

TECHNICAL FIELD

The present invention relates to vacuum cleaners and more particularly, to a vacuum cleaner surface cleaning head with a leading roller.

BACKGROUND INFORMATION

Vacuum cleaners generally include a suction conduit or nozzle on the underside of a surface cleaning head for drawing air (and debris) into or through the surface cleaning head. One of the challenges with vacuum cleaner design is to control engagement of the suction conduit with a surface being cleaned to provide the desired amount of suction. If the suction conduit is spaced too far from a surface, the suction may be less because the air is flowing into the suction conduit through a greater surface area. If the suction conduit is directly engaged with the surface and thus sealed on all sides, air will stop flowing into the suction conduit and the suction motor may be damaged as a result.

Vacuum cleaners also generally use agitation to loosen debris and facilitate capturing the debris in the flow of air into the suction conduit. Agitators are often used in the suction conduit of a surface cleaning head proximate a dirty air inlet to cause the agitated debris to flow into the dirty air inlet. If the agitator in the suction conduit is unable to loosen the debris or if the debris is too small, the suction conduit may pass over the debris without removing the debris from the surface. In other cases, the surface cleaning head may push larger debris forward without ever allowing the debris to be captured in the flow into the suction conduit (sometimes referred to as snowplowing).

SUMMARY

Consistent with an embodiment, a surface cleaning head includes a housing having a front side and back side. The housing defines a suction conduit with an opening on an underside of the housing between the front side and the back side. The surface cleaning head also includes a brush roll rotatably mounted within the suction conduit and proximate the opening of the suction conduit and a leading roller rotatably mounted to the front side of the housing in front of and spaced from the brush roll to define an inter-roller air passageway between lower portions of the brush roll and the leading roller. The leading roller has an outer diameter that is less than an outer diameter of the brush roll. At least an upper half of the leading roller is outside of a flow path to the suction conduit and a bottom portion of the leading roller is exposed to the flow path to the suction conduit. The leading roller is in front of the opening of the suction conduit such that the leading roller at least partially seals a front side of the suction conduit when used on a surface being cleaned and directs debris from the surface being cleaned to the suction conduit.

Consistent with another embodiment, a surface cleaning head includes a housing having a front side and back side. The housing defines a suction conduit with an opening on an underside of the housing between the front side and the back side. The surface cleaning head also includes a leading roller rotatably mounted to the front side of the housing adjacent the opening of the suction conduit. The leading roller floats relative to the housing for engaging a surface being cleaned and at least partially seals a front side of the suction conduit and directs debris to the suction conduit.

Consistent with a further embodiment, a surface cleaning head includes a housing having a front side and back side. The housing defines a suction conduit with an opening on an underside of the housing between the front side and the back side. The surface cleaning head also includes a brush roll rotatably mounted within the suction conduit and above the opening of the suction conduit and a leading roller rotatably mounted to the front side of the housing in front of the brush roll and adjacent the opening of the suction conduit. An adjusting mechanism is coupled to the leading roller for adjusting a position of the leading roller relative to the brush roll between at least a lowered position and a raised position. A bottom contact surface of the leading roller is located below a bottom contact surface of the brush roll in the lowered position such that the leading roller contacts a surface to be cleaned. A bottom contact surface of the leading roller is located above the bottom contact surface of the brush roll in the raised position such that the leading roller is spaced from the surface being cleaned and the brush roll contacts the surface being cleaned.

BRIEF DESCRIPTION OF THE DRAWINGS

These and other features and advantages will be better understood by reading the following detailed description, taken together with the drawings wherein.

DETAILED DESCRIPTION

Figure 1:
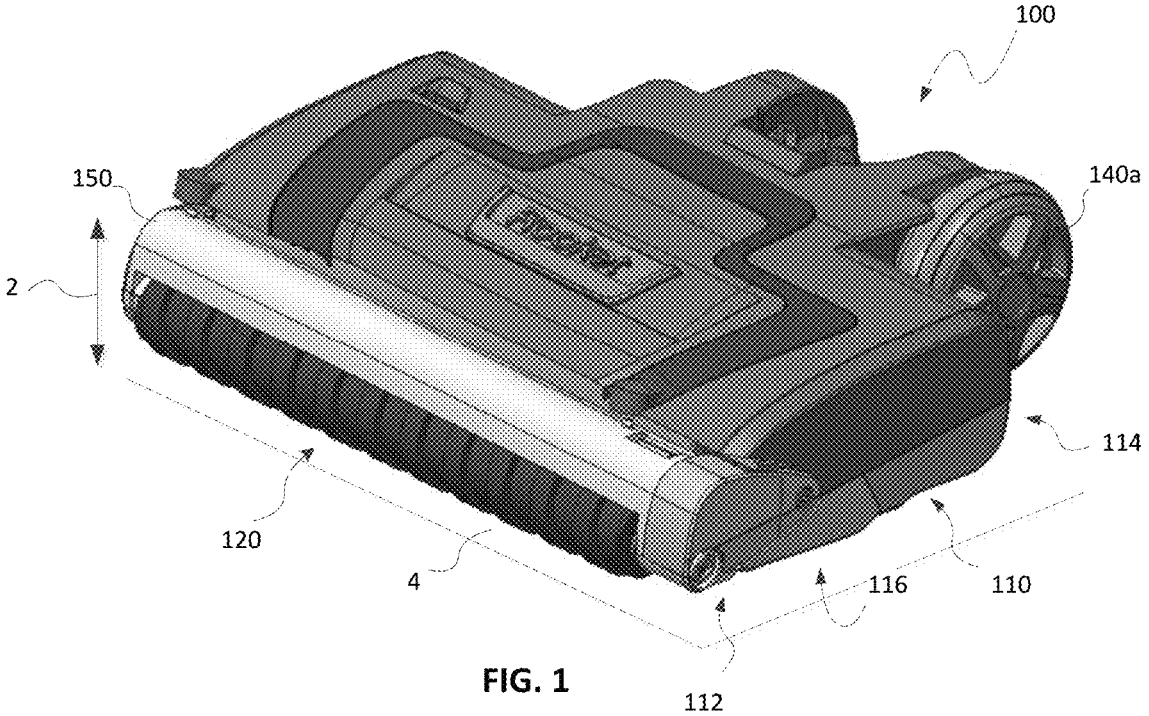
FIG. 1 is a top perspective view of a surface cleaning head with a leading roller, consistent with an embodiment of the present disclosure.

A surface cleaning head with a leading roller, consistent with embodiments of the present disclosure, may be used to facilitate capturing of debris in the air flow into a suction conduit on the underside of the surface cleaning head. The leading roller is generally positioned adjacent to and in advance of the opening of the suction conduit such that the leading roller engages the debris and moves the debris toward the opening of the suction conduit. In an embodiment, the surface cleaning head may have dual agitators—a leading roller and a rotating brush roll—with the leading roller being located in front of the brush roll. The leading roller may have a smaller diameter than the brush roll and may provide a softer cleaning element than the brush roll. The leading roller may also have a bottom portion exposed to the flow path to the suction conduit and a top portion that is not exposed to the flow path to the suction conduit. In other embodiments of the surface cleaning head, the leading roller may float relative to the surface cleaning head and/or may be adjustable relative to the brush roll.

Although specific embodiments of the surface cleaning head with a leading roller are shown, other embodiments of the surface cleaning head with a leading roller are within the scope of the present disclosure. The surface cleaning head with a leading roller may be used in different types of vacuum cleaners including, without limitation, an "all in the head" type vacuum, upright vacuum cleaners, canister vacuum cleaners, stick vacuum cleaners, robotic vacuum cleaners and central vacuum systems. The surface cleaning head with a leading roller may also include removable agitators or brush rolls in openable agitator chambers, such as the type described in greater detail in U.S. Pat. No. 9,456,723 and U.S. Patent Application Pub. No. 2016/0220082, which are commonly-owned and fully incorporated herein by reference. The leading roller may be similarly removable.

As used herein, a "surface cleaning head" refers to a device configured to contact a surface for cleaning the surface by use of suction air flow, agitation, or a combination thereof. A surface cleaning head may be pivotably or steeringly coupled by a swivel connection to a wand for controlling the surface cleaning head and may include motorized attachments as well as fixed surface cleaning heads. A surface cleaning head may also be operable without a wand or handle. As used herein, "float" or "floating" refers to the leading roller being movable relative to the housing and without supporting the weight of the surface cleaning head. As used herein, "seal" or "sealing" refers to preventing a substantial amount of air from passing through to the suction conduit but does not require an air tight seal. As used herein, "agitator" refers to any element, member or structure capable of agitating a surface to facilitate movement of debris into a suction air flow in a surface cleaning head. As used herein, "soft" and "softer" refer to the characteristics of a cleaning element on the leading roller being more compliant or pliable than another cleaning element. As used herein, the term "flow path" refers to the path taken by air as it flows into a suction conduit when drawn in by suction. As used herein, the terms "above" and "below" are used relative to an orientation of the surface cleaning head on a surface to be cleaned and the terms "front" and "back" are used relative to a direction that a user pushes the surface cleaning head on a surface being cleaned (i.e., back to front). As used herein, the term "leading" refers to a position in front of at least another component but does not necessarily mean in front of all other components.

Referring to FIGS. 1-4, a surface cleaning head 100, consistent with an embodiment of the present disclosure, includes a housing 110 having a front side 112 and a back side 114 and a leading roller 120 rotatably mounted at the front side 112 of the housing 110. Although the leading roller 110 provides the leading edge of the surface cleaning head 100 in the illustrated embodiment, the front side 112 of the housing 110 may also extend in front of the leading roller 110 to provide the leading edge. The leading roller 120 may float relative to the housing 110 such that the leading roller 120 is movable generally in the direction of arrow 2 relative to the surface 4 being cleaned, as will be described in greater detail below. The leading roller 120 may include a relatively soft material (e.g., soft bristles, fabric, felt, nap or pile) arranged in a pattern (e.g., a spiral pattern) to facilitate capturing debris, as will be described in greater detail below.

Figure 2:
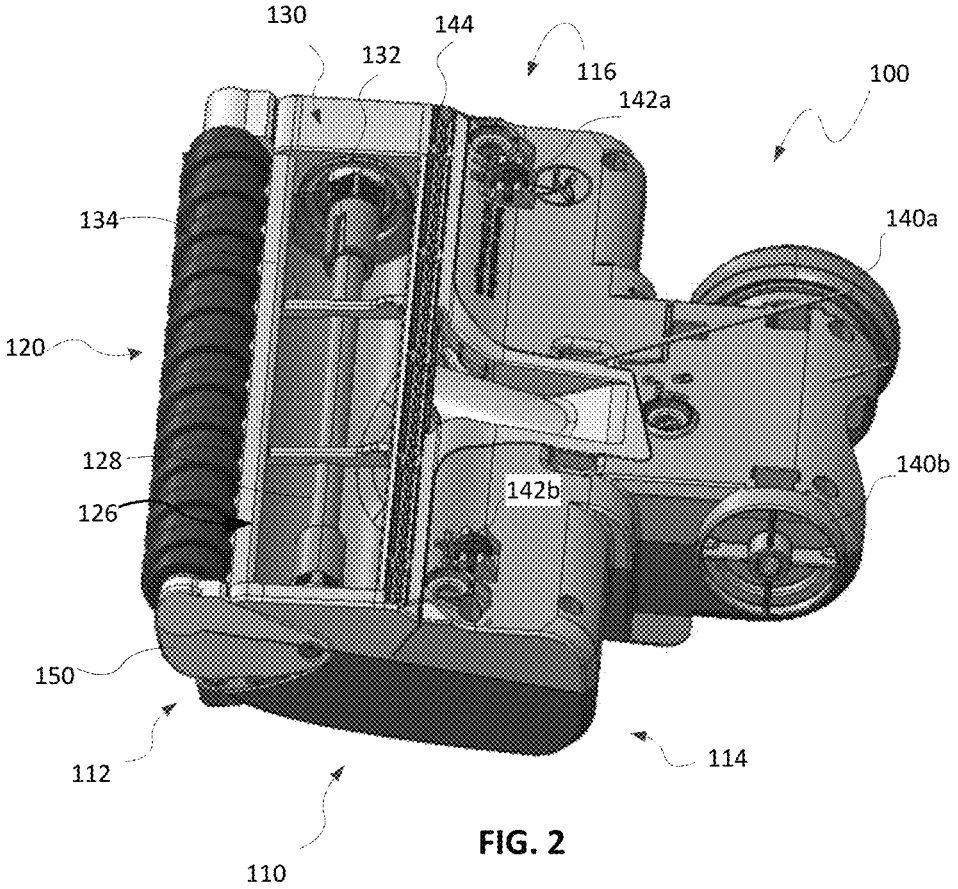
FIG. 2 is a bottom perspective view of the surface cleaning head with a leading roller shown in FIG. 1.
Figure 3:
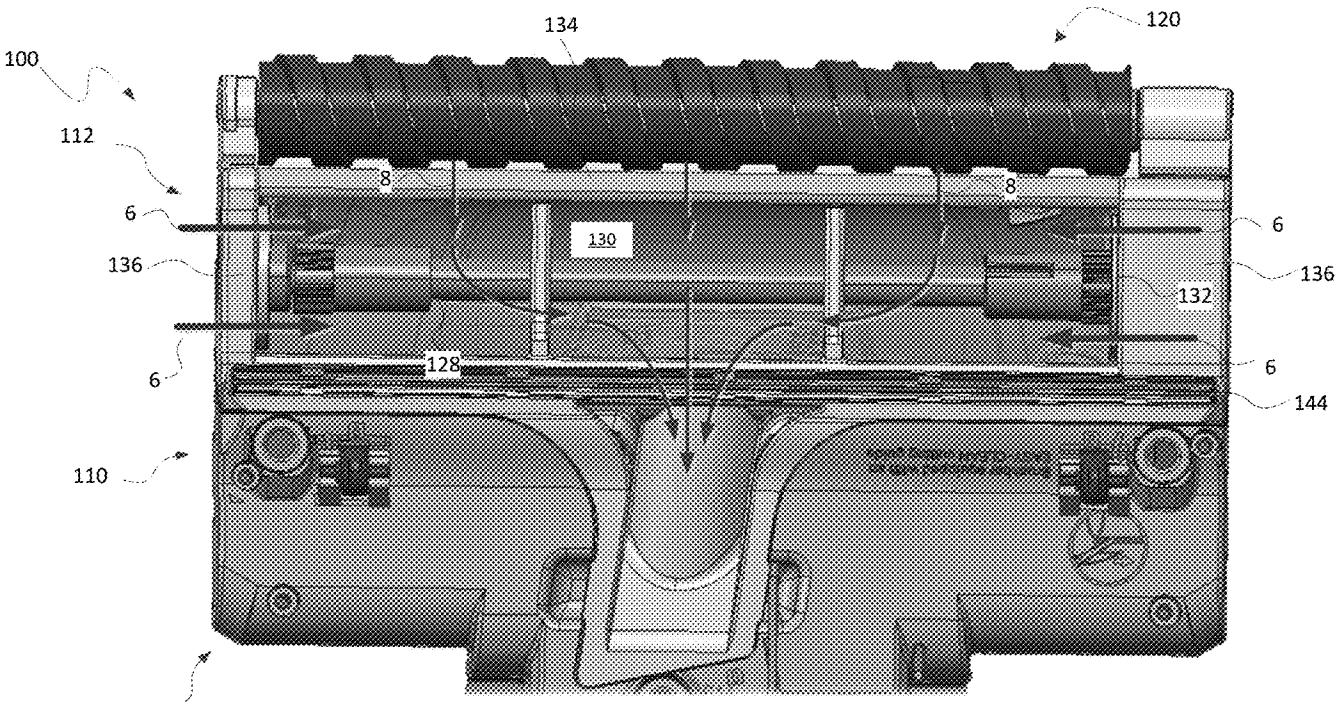
FIG. 3 is a bottom view of the surface cleaning head with a leading roller shown in FIG. 1.
Figure 4:
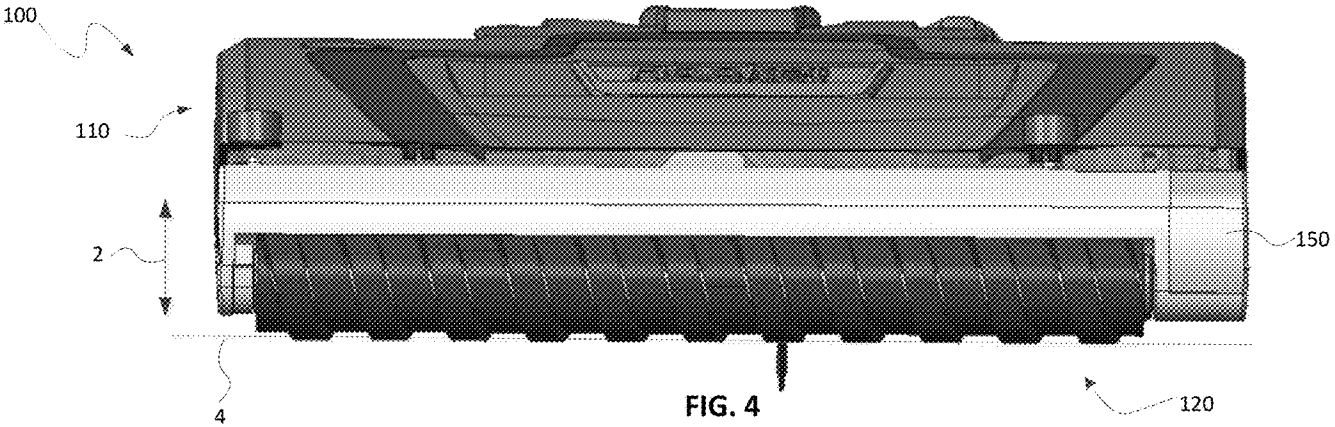
FIG. 4 is a front view of the surface cleaning head with a leading roller shown in FIG. 1.

The housing 110 defines a suction conduit 130 having an opening 132 on an underside 116 of the housing, as shown in FIGS. 2 and 3. The suction conduit 130 is fluidly coupled to a suction motor (not shown) either in the surface cleaning head 100 or another location in the vacuum. The suction conduit 130 is the interior space defined by interior walls in the housing 110, which receives and directs air drawn in by suction, and the opening 132 is where the suction conduit 130 meets the underside of the housing 110. In the illustrated embodiment, the leading roller 120 is in front of the opening 132 to the suction conduit 130 and is at least about the same length as the opening 132. The leading roller 120 thus directs debris into the opening 132 and at least partially seals off the front side of the opening 132 to the suction conduit 130. By sealing off the front side of the underside of the housing 110, the suction may be increased, particularly at the sides as shown by arrows 6, which improves the removal of debris (e.g., fine debris particles) from the surface being cleaned. While sealing off the front side of underside of the housing 110, the leading roller 120 may still direct debris to the opening 132 as shown by arrows 8.

Figure 5:
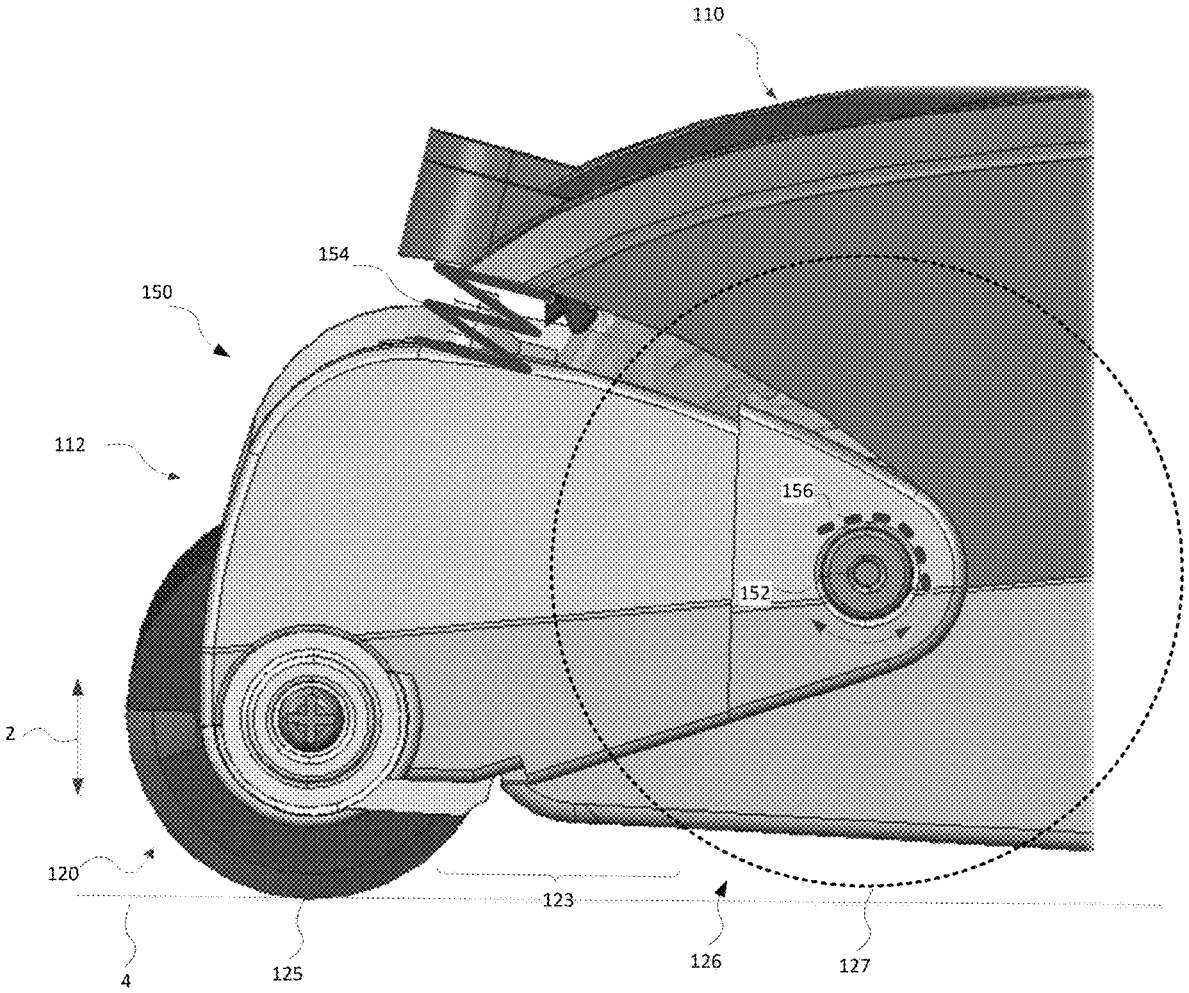
FIG. 5 is a side view of a pivoting roller support supporting the leading roller at the front of the surface cleaning head shown in FIG. 1.

In this embodiment, at least an inside bottom portion of the leading roller 120 is in the flow path into the suction conduit 130 because the bottom portion is exposed to air drawn into the suction conduit 130. At least an inside upper portion (e.g., at least an inside upper half) of the leading roller 120 is substantially outside the flow path into the suction conduit 130 because the upper portion of the leading roller 120 is located behind a wall 134 defining the suction conduit 130 and thus substantially not exposed to the air drawn into the suction conduit 130. Other variations are possible with different portions of the leading roller 120 being exposed to the air path. The spacing between the leading roller 120 and the brush roll 126 provides an inter-roller passageway 123 between the lower portions of the leading roller 120 and the brush roll 126 (FIG. 5). The inter-roller passageway 123 provides at least a portion of the flow path to the suction conduit 130 and thus allows debris from the leading roller 120 to pass into the suction conduit 130.

Figure 7:
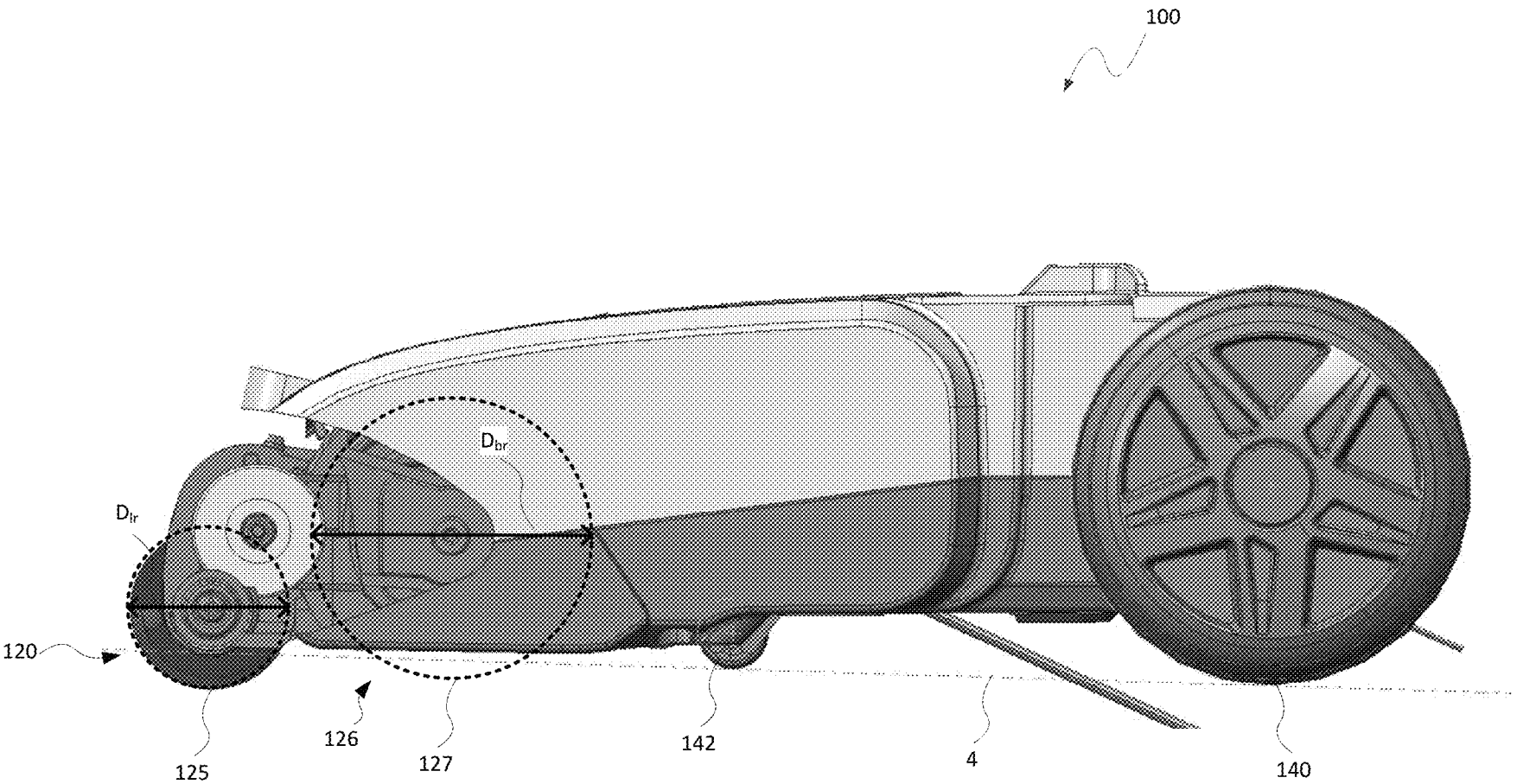
FIG. 7 is a side view of an embodiment of a surface cleaning head designed to be supported on wheels with the leading roller floating.

In the illustrated embodiment, as shown in FIGS. 5 and 7, the surface cleaning head 100 includes dual agitators, i.e., the leading roller 120 and a rotating brush roll 126 located in the suction conduit 130 proximate the opening 132. The rotating brush roll 126 may have bristles, fabric, or other cleaning elements, or any combination thereof around the outside of a brush bar 128. Examples of brush rolls and other agitators are shown and described in greater detail in U.S. Pat. No. 9,456,723 and U.S. Patent Application Pub. No. 2016/0220082, which are fully incorporated herein by reference. The leading roller 120 is in front of the rotating brush roll 128 and may be driven from the same drive mechanism used to drive the rotating brush roll 128, as will be described in greater detail below.

As shown in FIGS. 5 and 7, the leading roller 120 has a smaller diameter than the brush roll 126, which allows better front end cleaning at a wall or other vertical surface and allows for a lower profile at a front of the surface cleaning head. In some embodiments, the diameter $D_{lr}$ of the leading roller 120 is about ½ the diameter $D_{br}$ of the brush roll 126 or less. In other embodiments, the diameter $D_{lr}$ of the leading roller 120 is about ¾ the diameter $D_{br}$ of the brush roll 126 or less. In some embodiments, a bottom contact surface 125 of the leading roller 120 may be located below a bottom contact surface 127 of the brush roll 126. In other embodiments, the bottom contact surface 125 of the leading roller 120 may be located above the bottom contact surface 127 of the brush roll 126.

The surface cleaning head 100 also includes one or more wheels 140*a*-142*b* for supporting the housing 110 on the surface 4 being cleaned. In the illustrated embodiment, the surface cleaning head 100 includes one or more larger rear wheels 140*a*, 140*b* at the back side 114 of the housing 110 and one or more smaller middle wheels 142*a*, 142*b* at a middle section on the underside 116 of the housing 110. Other wheel configurations may also be used. As shown in greater detail in FIG. 7, the rear wheel(s) 140 and the middle wheel(s) 142 provide the primary contact with the surface being cleaned and thus primarily support the surface cleaning head 100. When the surface cleaning head 100 is positioned on the surface being cleaned the leading roller 120 will move such that the leading roller 120 also rests on the surface being cleaned. In other embodiments, the leading roller 120 may be positioned such that the leading roller 120 sits just above the surface being cleaned.

As shown in FIGS. 2 and 3, the surface cleaning head 100 may further include one or more sealing strips 144 along a rear side of the opening 132 to the suction conduit 130. The sealing strip 144 may extend the length of the opening 132 or longer and may include soft bristles, fabric material, rubber material, or other material capable of contacting the surface being cleaned to substantially prevent air flow into the opening 132 from the rear side. The sealing strip 144 may also include a combination of elements or materials, such as bristles with a rubber strip extending along the strip between the bristles (e.g., with the bristles being longer than the rubber strip). Side edge air passageways 136 may be formed between the sealing strip 144 and the leading roller 120 to provide at least a portion of the air flow path allowing the air flow into the suction conduit 130 (e.g., in the direction of arrows 6). In other embodiments, one or more sealing strips may also be located along at least a portion of the left and right sides of the opening 132 (e.g., see FIG. 14).

In the example embodiment, as shown in greater detail in FIG. 5, the leading roller 120 is rotatably mounted in a pivoting roller support 150, which allows the leading roller 120 to float (e.g., as shown by arrow 2). The pivoting roller support 150 is pivotably mounted at one or more pivot points 152 on the front side 112 of the housing 110. A biasing mechanism may be used to bias the pivoting roller support 150 and the leading roller 120 toward the surface 4. In the illustrated embodiment, the biasing mechanism includes a compression spring 154, such as a helical or coil spring, between the pivoting roller support 150 and the housing 110. Additionally or alternatively, a torsion spring 156 may be used at one or both pivot joints 152. In other embodiments, the weight of the roller support 150 and the roller 120 alone may provide the necessary bias toward the surface 4 or an additional weight may be used.

Figure 8:
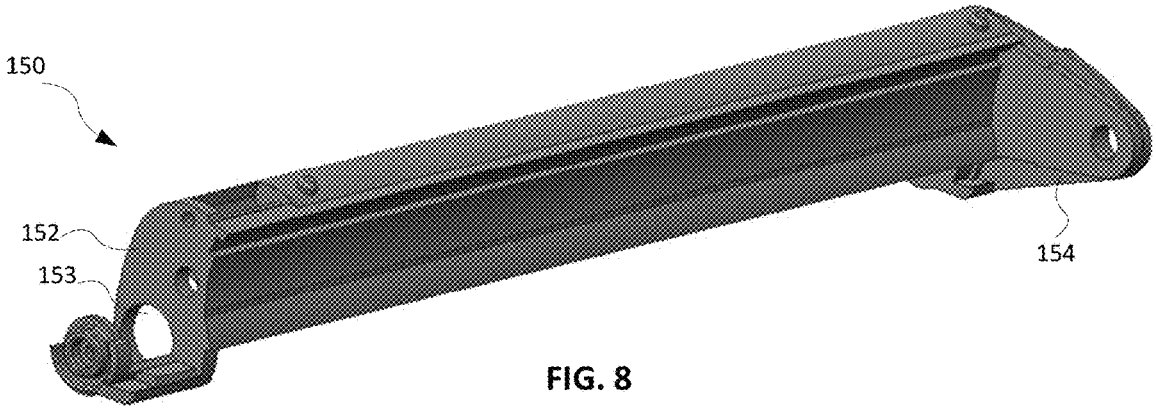
FIG. 8 is a perspective view of an embodiment of a pivoting roller support for use with a surface cleaning head with a leading roller.
Figure 10:
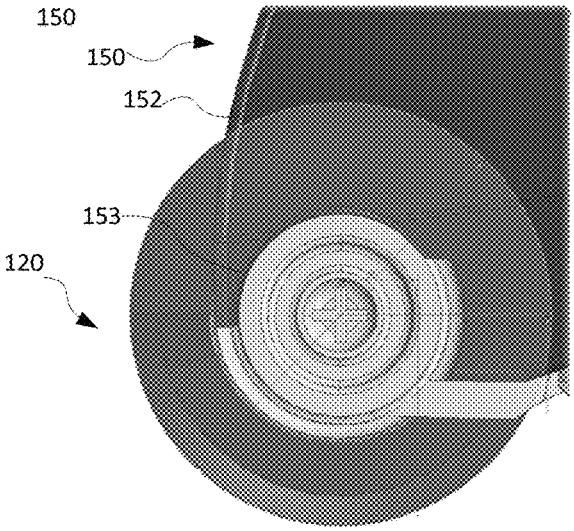
FIG. 10 is an enlarged side view of an embodiment of the leading roller.

An embodiment of the pivoting roller support 150 is shown in greater detail in FIG. 8. The pivoting roller support 150 may include a roller support body 152 with apertures 153 for rotatably supporting the leading roller, as shown in FIG. 10. The pivoting roller support 150 may also include one or more pivot arms 154 extending from the roller support body 152 for pivotably coupling to the housing 110. The roller support 150 may be made of one or more pieces and may also have other shapes and/or configurations. Other structures may also be used for supporting the leading roller 120 relative to the housing 110 such that the leading roller floats relative to the housing 110 and the surface 4. In other embodiments, for example, the leading roller support 150 may be coupled to the housing 110 with a suspension system such that the support 150 and roller 120 move linearly.

Figure 6:
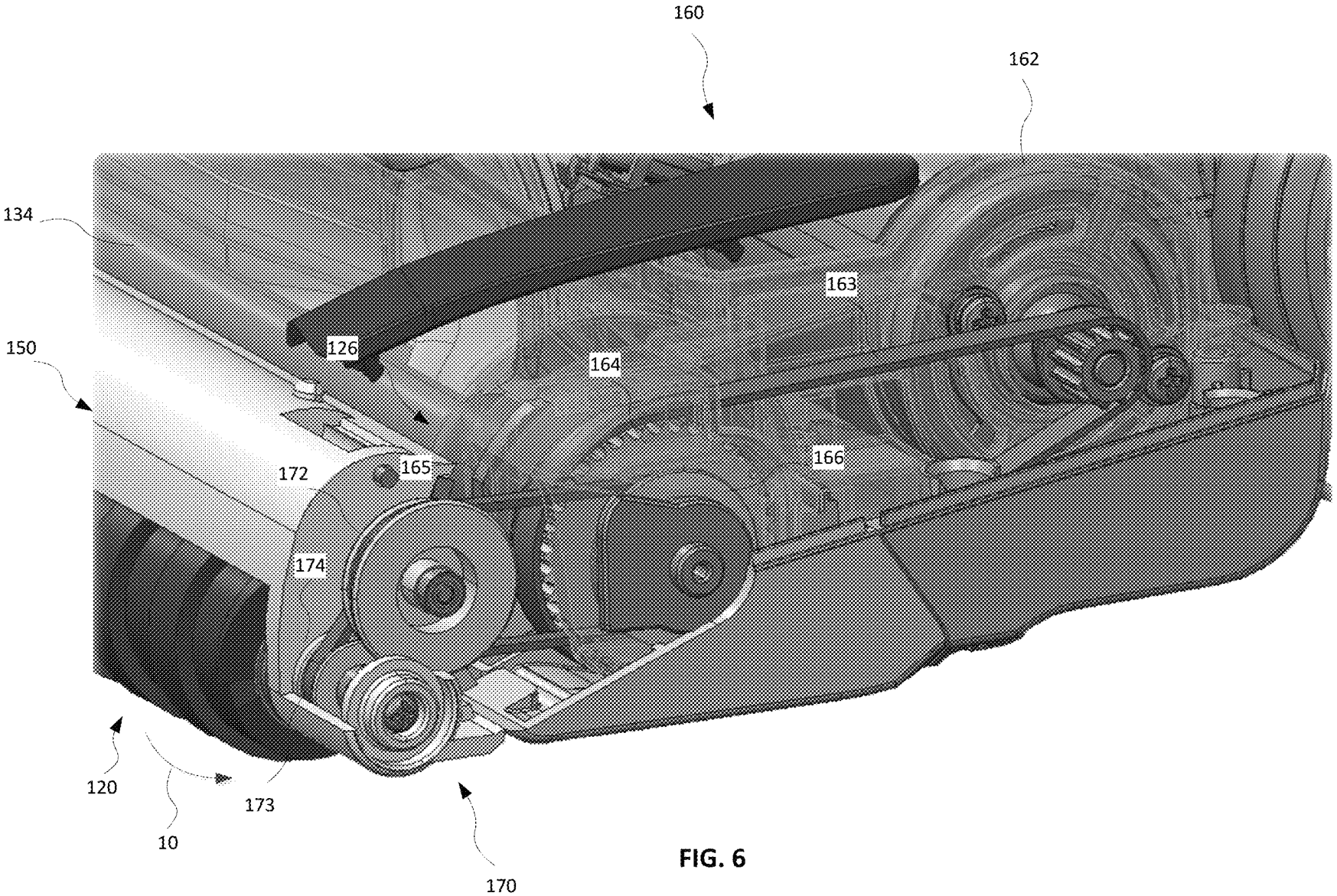
FIG. 6 is a cut-away view of the drive mechanism for driving both a brush roll and the leading roller on the surface cleaning head shown in FIG. 1.
Figure 9:
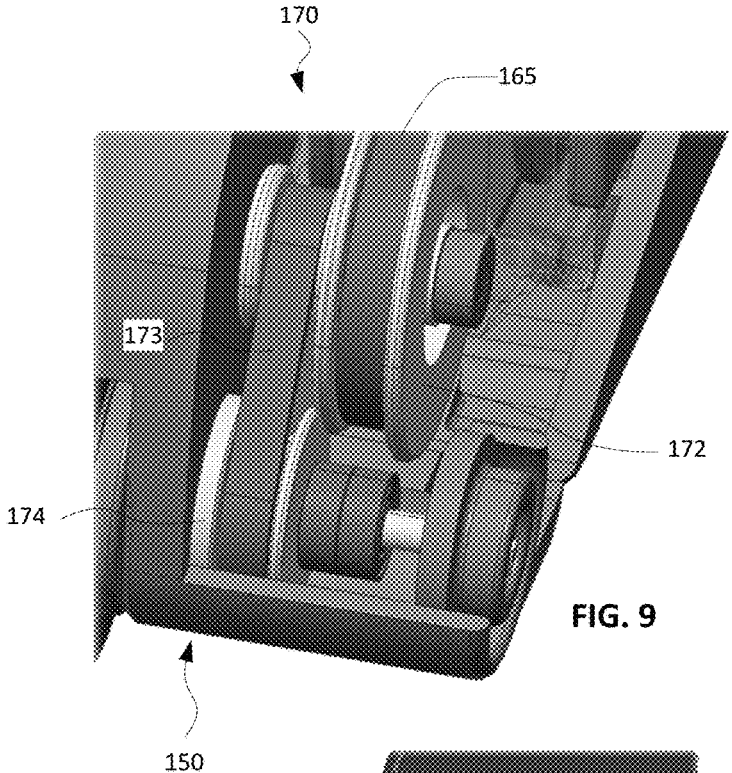
FIG. 9 is a perspective view of an embodiment of a leading roller drive mechanism used to drive the leading roller with a gear reduction.

In the example embodiment, as shown in greater detail in FIG. 6, the leading roller 120 is rotatably driven by a brush roll drive mechanism 160 that also drives the rotating brush roll 126. In this embodiment, the drive mechanism 160 includes a drive motor 162 drivingly engaged (e.g., with a belt 163) to a brush roll drive wheel 164 for driving the brush roll 126. A transfer wheel 166 is fixedly coupled to the brush roll drive wheel 164 such that the transfer wheel 166 rotates with the brush roll drive wheel 164. The transfer wheel 166 is drivingly engaged with a leading roller drive mechanism 170 mounted on the roller support 150, also shown in FIG. 9.

In this embodiment, the leading roller drive mechanism 170 provides a gear reduction and includes at least a first roller drive wheel 172 drivingly engaged to the transfer wheel (e.g., with a belt 165) and a second roller drive wheel 174 drivingly engaged with the first roller drive wheel 172 (e.g., with a belt 173). The second roll drive wheel 174 is coupled to the leading roller 120 and drives the roller 120 to cause the roller 120 to rotate in the direction of arrow 10, which is the same direction of rotation as the brush roll 126. In one example, the leading roller drive mechanism 170 provides a gear reduction of 2.5:1 and the second roller drive wheel 174 is smaller to provide the gear reduction. Other reductions and configurations are possible and within the scope of the present disclosure. In the illustrated embodiments, the drive mechanisms are belt drive mechanisms with pulleys and belts. In other embodiments, other types of drive mechanisms may be used such as, for example, gears or sprockets and chains.

The leading roller 120 may be configured to pick up larger debris (e.g., CHEERIOS® cereal) as well as smaller debris. In one embodiment, the material of the leading roller 120 may be sufficiently compliant to accommodate the larger debris. For example, the leading roller 120 may have felt or bristles with a length (e.g., 4-7 mm) in a range that will accommodate the larger debris. In another embodiment, the leading roller 120 may be biased with enough force for the roller core or body to contact the debris to drive the debris through with increased friction or to crush the debris into smaller debris particles. In a further embodiment, the leading roller 120 may use a spring to counter the weight of the roller 120 such that the roller 120 is effectively weightless or balanced relative to the surface being cleaned. The leading roller 120 may be balanced such that the weight of the roller 120 (if unopposed) causes the roller to move to the lower position against the surface being cleaned and a small force in the upward direction (e.g., caused by debris or other obstacle such as a carpet) causes the roller 120 to lift upwards.

The leading roller 120 may have an outer diameter in a range of about 15 to 20 mm. In some embodiments, a smaller roller (e.g., 19 to 21 mm) may be used. In other embodiments, a larger roller (e.g., 28 to 30 mm) may be used. In the example embodiment, the leading roller 120 includes at least a relatively soft material around the outside for contacting the surface being cleaned. The relatively soft material may include, without limitation, thin nylon bristles (e.g., a diameter of 0.04±0.02 mm) or a textile or fabric material, such as felt, or other material having a nap or pile suitable for cleaning a surface. Multiple different types of materials may be used together to provide different cleaning characteristics. A relatively soft material may be used, for example, with a more rigid material such as stiffer bristles (e.g., nylon bristles with a diameter of 0.23±0.02 mm). Materials other than nylon may also be used such as, for example, carbon fibers.

The material may be arranged in a pattern around the roller 120, such as the spiral pattern shown in FIGS. 1-4, to facilitate movement of debris toward the opening 132 and into the suction conduit 130. The spiral pattern may be formed, for example, by a wider strip of the relatively soft material and a thinner strip of more rigid material. Other patterns may also be used and are within the scope of the present disclosure.

Figures 11A, 11B:
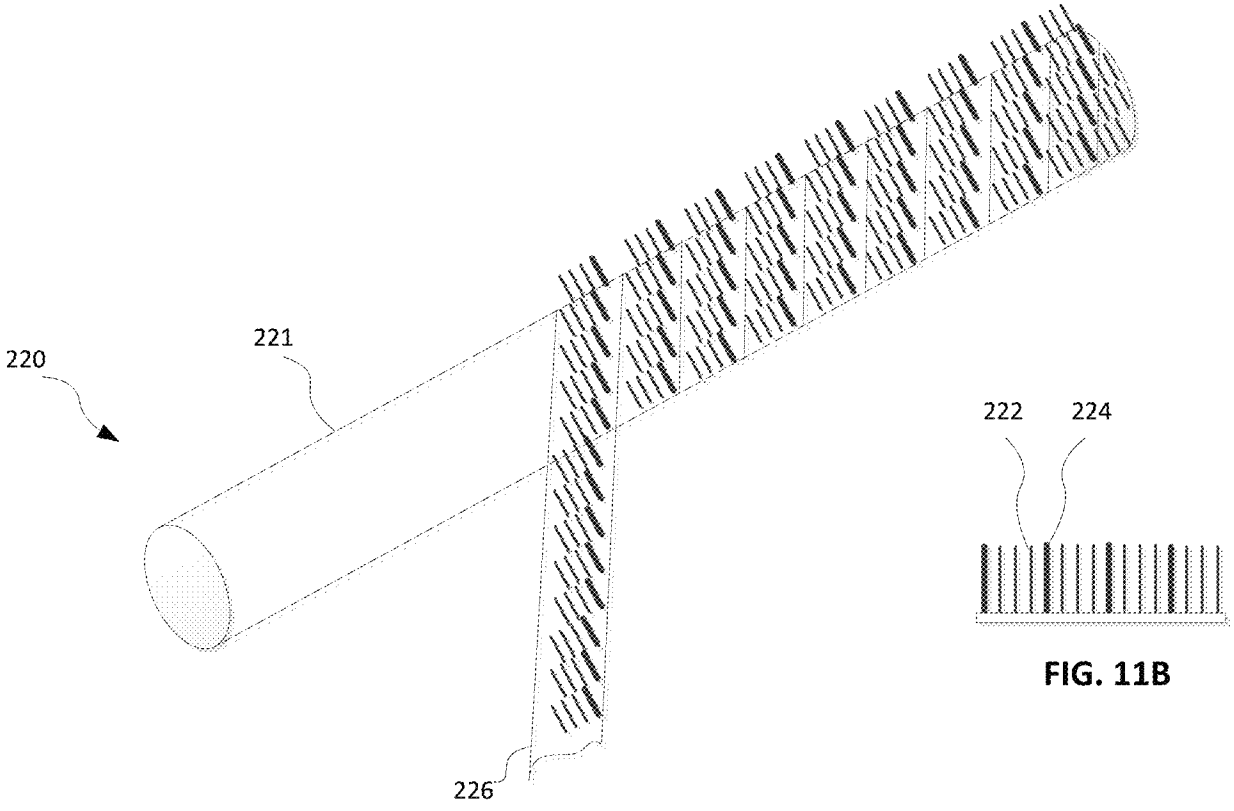
FIGS. 11A and 11B are perspective and side views of one embodiment of different types of bristles on a leading roller.
Figure 12:
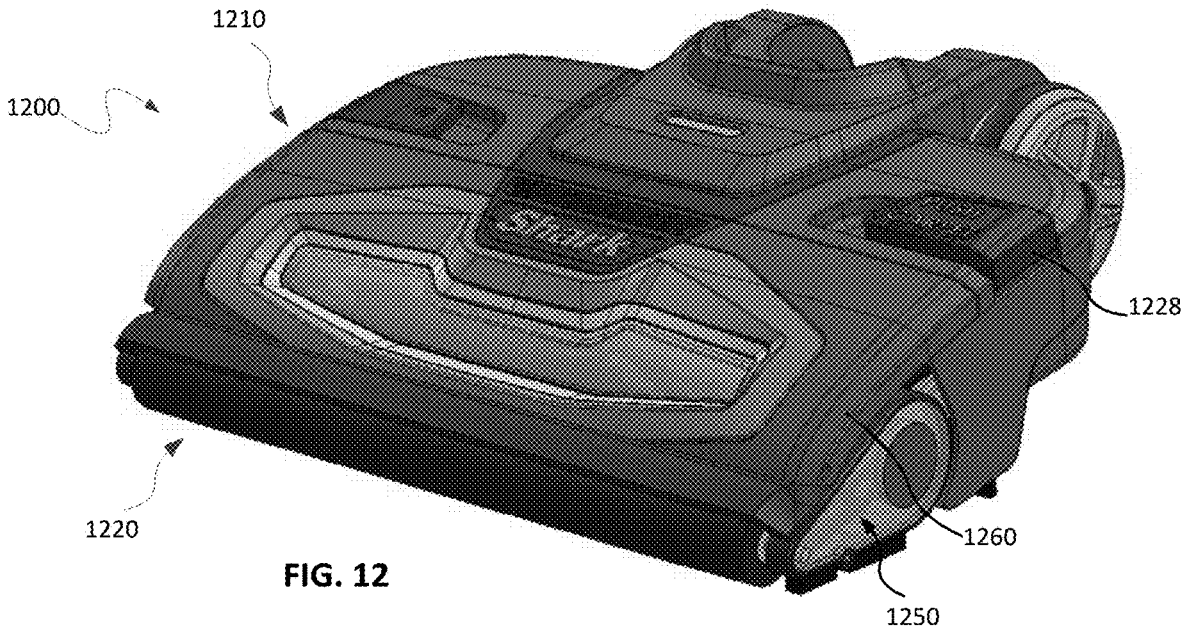
FIG. 12 is a top perspective view of a surface cleaning head with an adjustable leading roller, consistent with another embodiment of the present disclosure.
Figure 13:
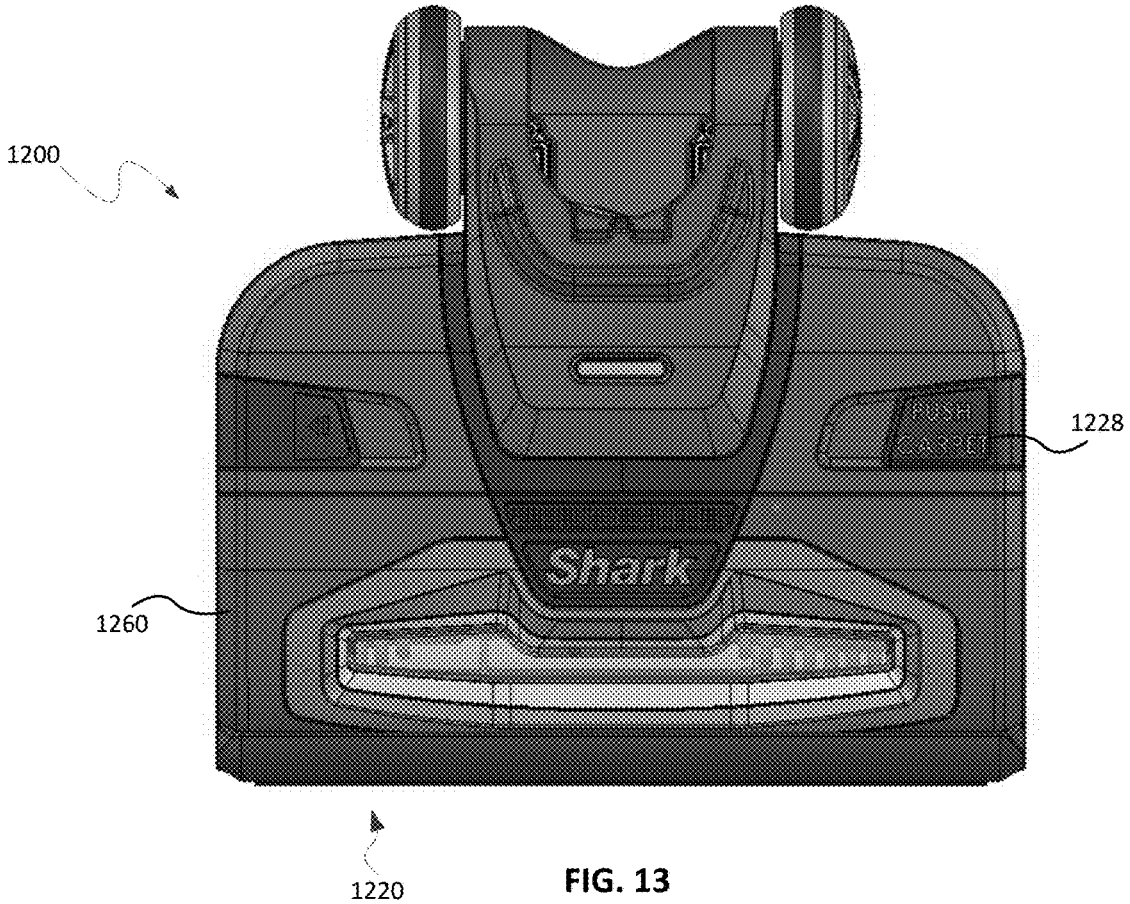
FIG. 13 is a top view of the surface cleaning head with an adjustable leading roller shown in FIG. 12.

Referring to FIGS. 11A and 11B, an embodiment of a leading roller 220 may include a first bristle material 222 covering a majority of the roller 220 and a second bristle material 224 covering less than a majority of the roller 220. The first and second bristle materials 222, 224 may be uniformly distributed but with different proportions. In this embodiment, the first and second bristle material 222, 224 both have approximately the same length; however, other embodiments may have different bristles materials with different lengths. The bristle materials 222, 224 may be both formed on a single fabric backing tape 226 that may be spiral wound onto a leading roller body 221. In one example, the first bristle material 222 includes non-conductive (e.g., nylon) bristles/fibers and the second bristle material 224 includes electrically conductive (e.g., carbon) bristles/fibers to dissipate static charges.

Referring to FIGS. 12-15, another embodiment of a surface cleaning head 1200, consistent with the present disclosure, includes an adjustable leading roller 1220 mounted to a housing 1210. In this embodiment, the surface cleaning head 1200 includes dual agitators—the leading roller 1220 in front of a suction conduit 1230 and a rotatable brush roll 1226 rotatably mounted within the suction conduit 1230. The adjustable leading roller 1220 may be adjusted to multiple positions for different applications and/or surfaces (e.g., hard floors or carpets). The adjustable leading roller 1220 may be raised and/or lowered by an adjustment mechanism activated by a foot pedal or switch 1228 on the surface cleaning head 1200. The adjustable leading roller 1220 may also be raised and/or lowered by an electronically controlled mechanism, which may be activated by a button or a sensor that senses the floor type.

The leading roller 1220 may be rotatably mounted in a roller support 1250, which is pivotably mounted to the housing 1210. An adjustment mechanism 1252 is operably coupled to the roller support 1250 and includes any type of mechanism capable of pivoting the roller support 1250 relative to the housing 1210, such as, for example, a gear mechanism, a belt mechanism, and/or mechanical linkages. In one embodiment, the adjustable leading roller 1220 may biased toward a lower position and the adjustment mechanism engages the roller support 1250 to pivot the roller support 1250 against the bias force, causing the leading roller 1220 to move in an upward direction. Although a pivoting roller support 1250 is shown, a translating roller support may also be used to move the leading roller 1220 linearly between raised and lowered positions.

Figure 14:
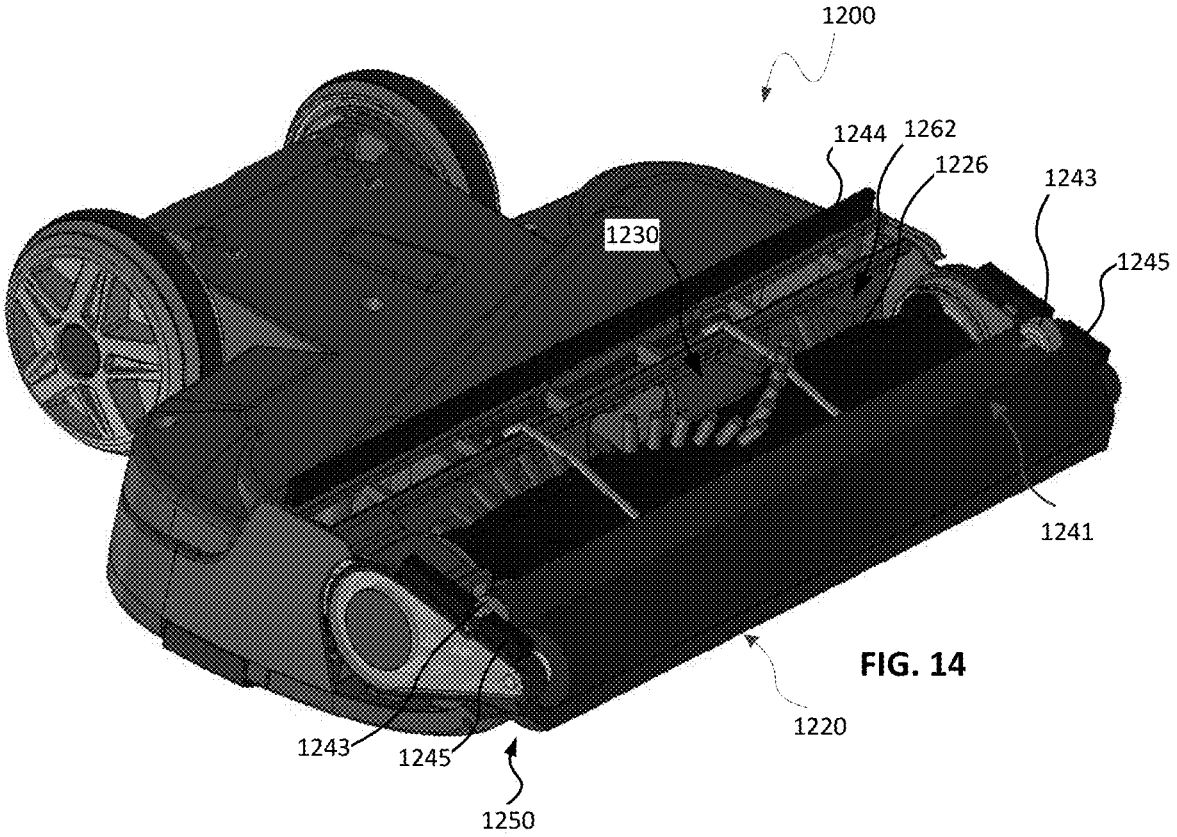
FIG. 14 is a bottom perspective view of the surface cleaning head with an adjustable leading roller shown in FIG. 12.

As shown in FIG. 14, the roller support includes a soleplate 1241 between the adjustable leading roller 1220 and the brush roll 1226 on an underside of the housing 1210. The soleplate 1241 is shown as a flat surface but may also include a series of castellations or teeth. In this embodiment, wheels 1243 are located at each side of the soleplate 1241. The soleplate 1241 and wheels 1243 may thus move with the leading roller 1220 such that they are in contact with the surface being cleaned when lowered and may be out of contact with a surface being cleaned when raised. The brush roll 1226 may be out of contact with the surface being cleaned when the adjustable leading roller 1220 is in a lower position and may contact the surface being cleaned when the adjustable leading roller 1220 is raised to a higher position, as discussed in greater detail below.

Figure 15A:
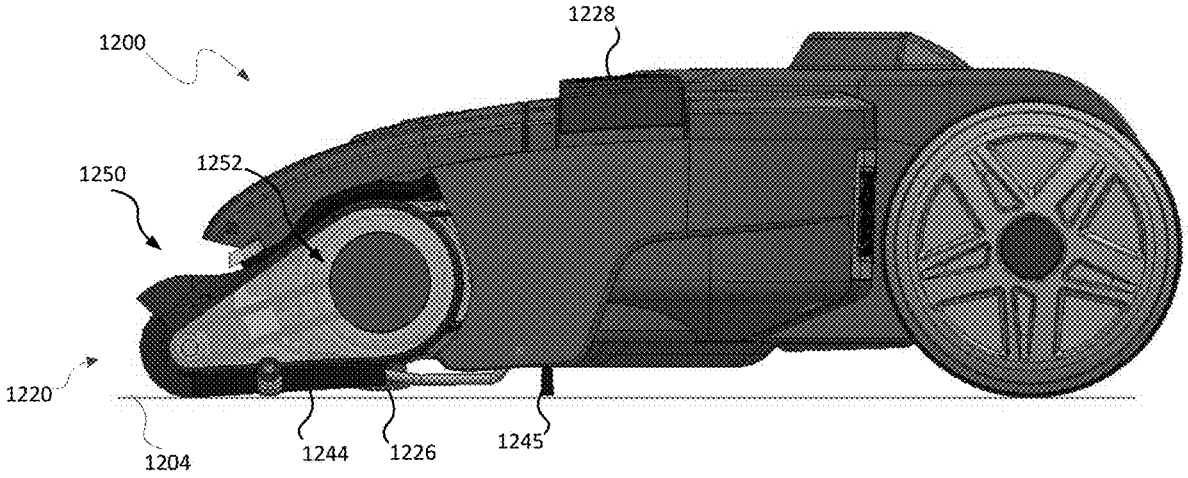
FIGS. 15A-15D are side views of the surface cleaning head shown in FIG. 12 illustrating different positions of the adjustable leading roller.
Figure 15B:
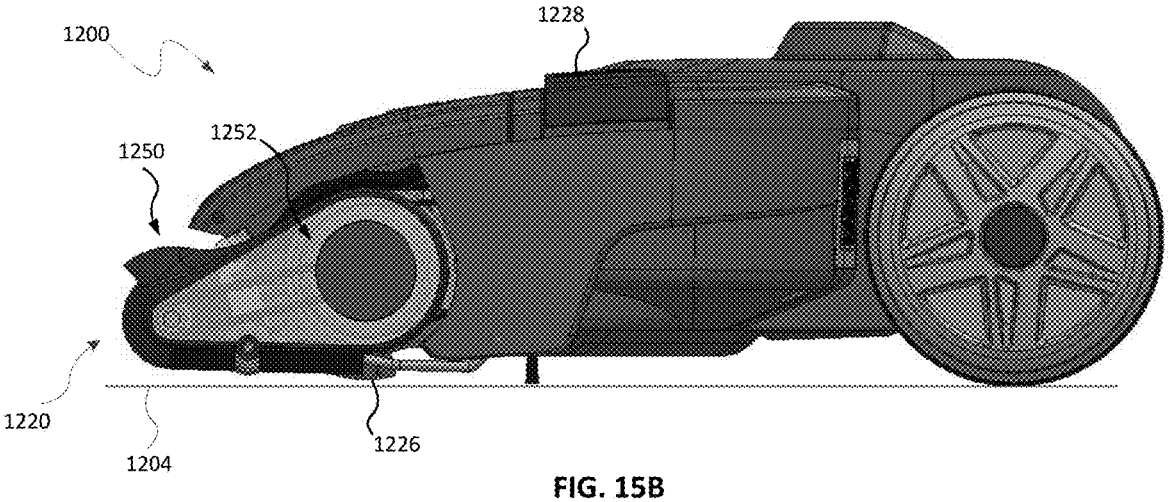
Figure 15C:
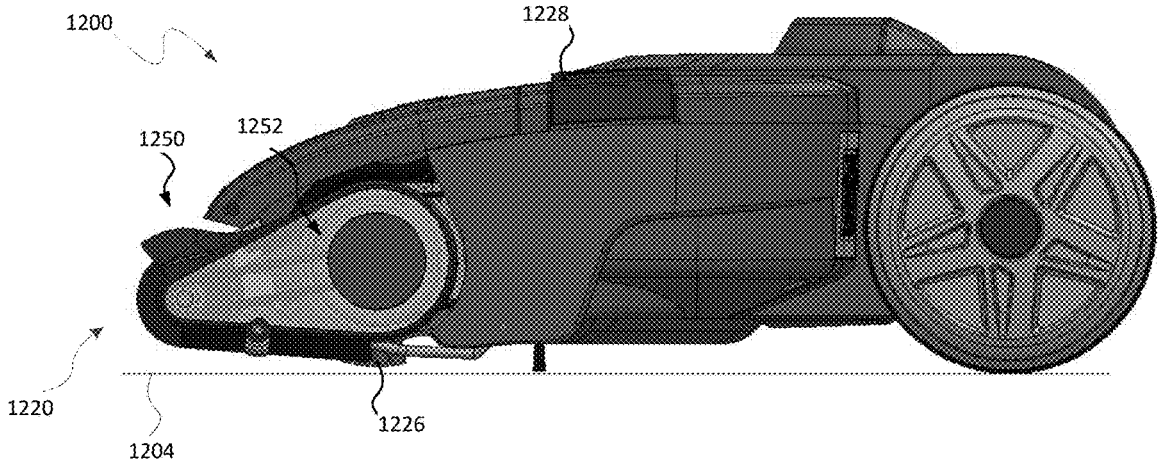
Figure 15D:
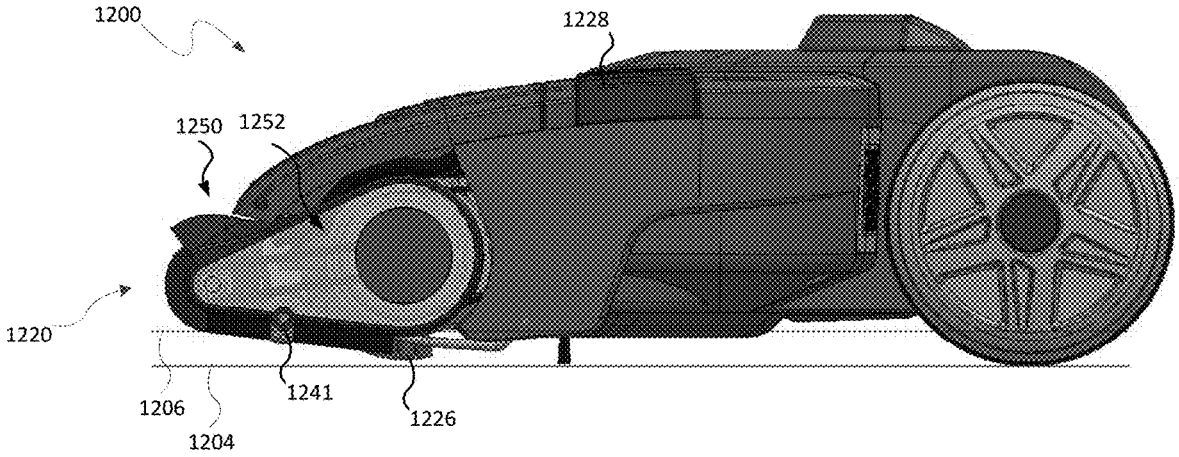

FIGS. 15A-15D show the adjustable leading roller 1220 in different positions. Depressing the switch causes the adjustable leading roller 1220 to move from the lowest position to the highest position. FIG. 15A shows the adjustable leading roller 1220 in a lowest position, for example, for use in a hard floor mode. In this position, the adjustable leading roller 1220 and wheels 1243 contact the hard floor 1204 and support the surface cleaning head 1200 such that the brush roll 1226 is raised from the floor 1204. FIG. 15D shows the adjustable leading roller 1220 in a highest position, for example, for use in a carpet mode. In this position, the surface cleaning head 1200 is supported on the carpet 1206 by the soleplate 1241 and/or wheels 1243 and the brush roll 1226 is allowed to extend into the carpet 1206. FIGS. 15B and 15C show intermediate positions of the adjustable leading roller 1220, which may be used for thinner carpets.

The surface cleaning head 1200 also includes a rear sealing strip 1244 and left and right side sealing strips 1245 on an underside of the housing. Side edge air passageways 1236 are formed between the rear sealing strip 1244 and the side sealing strips 1245 to direct air flow into the opening of the suction conduit. The side sealing strips 1245 may also be positioned closer to the rear sealing strip 1244. Other configurations of sealing strips are also possible and within the scope of the present disclosure.

In this embodiment, an external cover 1260 covers an agitator chamber 1262 (i.e., a portion of the suction conduit 1230) including the rotating brush roll 1226, which may be removable from the agitator chamber 1262. The external cover 1260 may pivot at one side to open and allow access to the agitator chamber 1262 from a top of the surface cleaning head 1200, thereby allowing the brush roll 1226 to be removed. Examples of removable rotating brush rolls located in agitator chambers with external covers are described in greater detail in U.S. Pat. No. 9,456,723 and U.S. Patent Application Pub. No. 2016/0220082, which are commonly-owned and fully incorporated herein by reference. Additionally or alternatively, the leading roller 1220 may also be removable and may be located in an agitator chamber with an external cover that opens to allow access to and removable of the roller 1220.

Figure 16A:
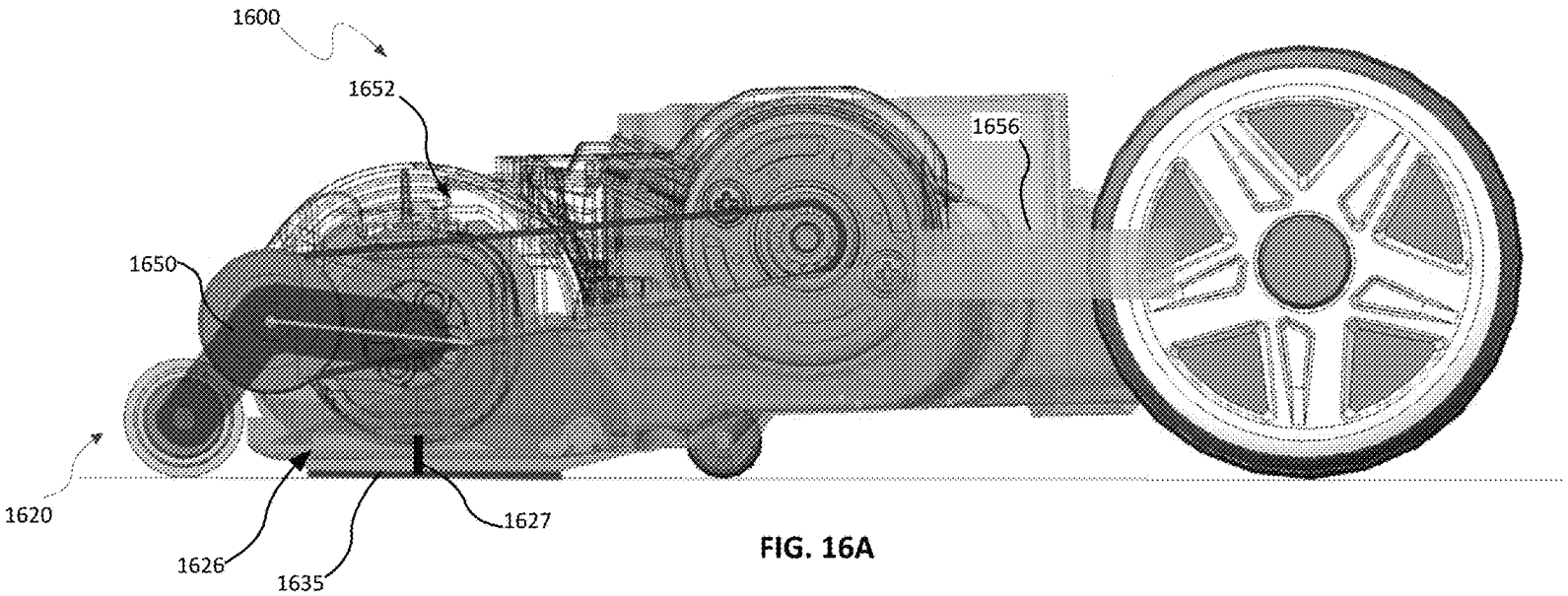
FIGS. 16A and 16B are side views of a surface cleaning head with an adjustable leading roller, consistent with yet another embodiment of the present disclosure.
Figure 16B:
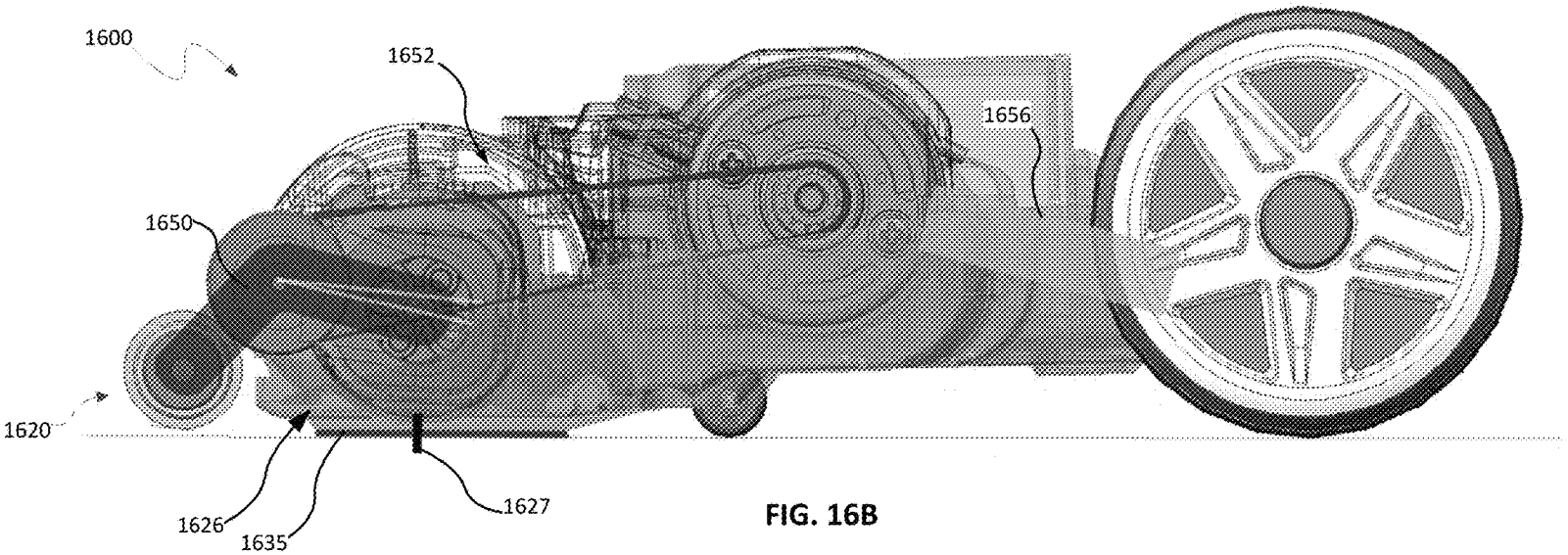

FIGS. 16A and 16B show yet another embodiment of a surface cleaning head 1600 with an adjustable leading roller 1620. In this embodiment, the leading roller 1620 and a brush roll 1626 are rotatably mounted to first and second ends of a lever 1650 that is pivotably mounted within the housing. The lever 1650 is pivoted to cause the leading roller 1620 and the brush roll 1626 to move simultaneously in opposite directions. An adjustment mechanism 1652 is coupled to the lever 1650 to cause the lever 1650 to pivot. The adjustment mechanism 1652 may include any mechanism capable of causing the lever 1640 to pivot and may be activated by a foot pedal 1656. The adjustment mechanism 1652 may include, for example, mechanical linkages between the foot pedal 1656 and the lever 1640, which cause the lever 1640 to rotate when the foot pedal 1656 is moved.

FIG. 16A shows the adjustable leading roller 1620 in a lowered position, for example, in a hard floor mode. In this position, the brush roll 1626 is raised relative to a fixed soleplate 1635 on an underside of the housing such that the brush roll bristles 1627 have about a 1 mm clearance with the hard floor. FIG. 16B shows the adjustable leading roller 1620 in a raised position, for example, in a carpet mode. In this position, the brush roll 1626 is lowered relative to the fixed soleplate 1635 such that the brush roll bristles 1627 extend below the soleplate 1635 to contact the carpet.

Accordingly, a surface cleaning head with a leading roller, consistent with embodiments disclosed herein, may improve the suction provided by a suction conduit and facilitate capture of debris into the suction conduit.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

What is claimed is:

1. A surface cleaning head comprising:

a housing having a front side and back side, the housing defining a suction conduit with an opening on an underside of the housing between the front side and the back side;

a brush roll rotatably mounted within the suction conduit and at least a portion of the brush roll being proximate the opening of the suction conduit;

a leading roller rotatably mounted to the front side of the housing in front of and spaced from the brush roll to define an inter-roller air passageway between lower portions of the brush roll and the leading roller, wherein the leading roller has an outer diameter that is less than an outer diameter of the brush roll, wherein at least an inside upper portion of the leading roller is substantially outside of a flow path to the suction conduit and wherein at least an inside bottom portion of the leading roller is exposed to the flow path to the suction conduit, and wherein the leading roller is in front of the opening of the suction conduit such that the leading roller at least partially seals a front side of the underside of the housing when used on a surface being cleaned and directs debris from the surface being cleaned to the inter-roller passageway;

a drive mechanism drivingly engaged with the rotating brush roll for driving the rotating brush roll and drivingly engaged with the leading roller for driving the leading roller; and at least one sealing strip extending from the underside of the housing, the at least one sealing strip comprising a rear sealing strip extending along a rear side of the opening;

wherein the underside of the housing at least partially defines side air passageways between the leading roller and the sealing strip to direct air to the opening along the underside at left and right sides of the housing.

2. The surface cleaning head of claim 1 wherein the outer diameter of the leading roller is less than or equal to ¾ of the outer diameter of the brush roll.

3. The surface cleaning head of claim 1 wherein the outer diameter of the leading roller is less than or equal to about half of the outer diameter of the brush roll.

4. The surface cleaning head of claim 1 wherein the leading roller has an outer diameter in a range of about 15 to 21 mm.

5. The surface cleaning head of claim 1 wherein the leading roller has a bottom contact surface at a location below a bottom contact surface of the brush roll.

6. The surface cleaning head of claim 1 wherein the brush roll includes bristles and wherein the leading roller includes a cleaning element that is softer than bristles.

7. The surface cleaning head of claim 1 wherein the at least one sealing strip includes left and right side sealing strips along left and right sides of the underside of the housing.

8. The surface cleaning head of claim 1 wherein the housing further includes a cover for covering a brush roll chamber including the brush roll, the cover being movable between a closed position and an open position.

9. The surface cleaning head of claim 8 wherein the brush roll is removable from the brush roll chamber when the cover is in the open position.

10. The surface cleaning head of claim 1 wherein the leading roller is removable.

11. A surface cleaning head comprising:

a housing having a front side and back side, the housing defining a suction conduit with an opening on an underside of the housing between the front side and the back side;

a brush roll rotatably mounted at least partially within the suction conduit;

a drive mechanism drivingly engaged with the brush roll for driving the rotating brush roll and drivingly engaged with the leading roller for driving the leading roller; and a leading roller coupled to the front side of the housing adjacent in front of the brush roll and in front of the opening of the suction conduit, wherein the leading roller floats relative to the housing independent of the brush roll for engaging a surface being cleaned, wherein the leading roller at least partially seals a front side of the underside of the housing and directs debris to the suction conduit.

12. The surface cleaning head of claim 11 wherein the brush roll is rotatably mounted at least partially within the suction conduit and above the opening of the suction conduit.

13. The surface cleaning head of claim 11 further including a pivoting roller support pivotably coupled to the front side of the housing, wherein the leading roller is rotatably mounted within the pivoting roller support.

14. The surface cleaning head of claim 13 further including a biasing mechanism coupled to the pivoting roller support for biasing the leading roller toward the surface being cleaned.

15. The surface cleaning head of claim 11 further including at least one rear wheel at the back side of the housing and least one middle wheel on the underside of the housing at a middle section of the housing, wherein the rear wheel and the middle wheel support the surface cleaning head.

16. The surface cleaning head of claim 15 wherein the leading roller floats at a position above bottom contact surfaces of the rear wheel and the middle wheel such that the leading roller is spaced from the surface being cleaned.

17. The surface cleaning head of claim 15 wherein the leading roller floats at a position below bottom contact surfaces of the rear wheel and the middle wheel such that the leading roller rests on the surface being cleaned.

18. The surface cleaning head of claim 11 wherein the leading roller is adjustable to at least a lowered position and a raised position.

19. The surface cleaning head of claim 11 wherein the leading roller includes at least one cleaning element in a spiral pattern along a body of the leading roller.

20. The surface cleaning head of claim 11 wherein the leading roller includes first and second cleaning elements in a spiral pattern along a body of the leading roller, the first and second cleaning elements having different characteristics.

21. A surface cleaning head comprising:

a housing having a front side and back side, the housing defining a suction conduit with an opening on an underside of the housing between the front side and the back side;

a brush roll rotatably mounted at least partially within the suction conduit and above the opening of the suction conduit;

a leading roller rotatably mounted to the front side of the housing in front of the brush roll and in front of the opening of the suction conduit;

a drive mechanism drivingly engaged with the brush roll for driving the brush roll and drivingly engaged with the leading roller for driving the leading roller; and an adjusting mechanism coupled to the leading roller for adjusting a position of the leading roller independent of the brush roll between at least a lowered position and a raised position, wherein a bottom contact surface of the leading roller is located below a bottom contact surface of the brush roll in the lowered position such that the leading roller contacts a surface to be cleaned, and wherein a bottom contact surface of the leading roller is located above the bottom contact surface of the brush roll in the raised position such that the leading roller is spaced from the surface being cleaned and the brush roll contacts the surface being cleaned.

22. The surface cleaning head of claim 21 further comprising wherein the adjusting mechanism includes a foot pedal or switch.

23. The surface cleaning head of claim 21 wherein the housing includes a soleplate, and wherein the bottom contact surface of the leading roller is located below the soleplate in the lowered position and above the soleplate in the raised position.

* * * * *